US006431254B2

(12) United States Patent
Dittrich

(10) Patent No.: US 6,431,254 B2
(45) Date of Patent: Aug. 13, 2002

(54) APPARATUS FOR CASTING A MOLDED PART

(75) Inventor: Oskar Dittrich, Donzdorf (DE)

(73) Assignee: Fa. Karl Walter Formen, Göppingen-Ursenwang (DE)

( * ) Notice: Subject to any disclaimer, the term of this patent is extended or adjusted under 35 U.S.C. 154(b) by 0 days.

(21) Appl. No.: 09/775,828

(22) Filed: Feb. 5, 2001

(30) Foreign Application Priority Data

Feb. 3, 2000 (DE) ..... 100 04 714

(51) Int. Cl.[7] ..... B22D 33/04

(52) U.S. Cl. ..... 164/137; 164/339; 164/340; 164/341

(58) Field of Search ..... 164/137, 339, 164/340, 341, 342, 122.1

(56) References Cited

U.S. PATENT DOCUMENTS

| | | | | |
|---|---|---|---|---|
| 5,415,464 A | | 5/1995 | Scott | |
| 5,427,171 A | | 6/1995 | Prieto | |
| 5,810,067 A | * | 9/1998 | Atari et al. | 164/120 |
| 5,810,068 A | * | 9/1998 | Kato | 164/306 |
| 5,865,241 A | * | 2/1999 | Bishenden et al. | 164/137 |
| 5,896,912 A | * | 4/1999 | Monroe et al. | 164/134 |
| 6,186,218 B1 | * | 2/2001 | Prieto | 164/339 |
| 6,318,446 B1 | * | 11/2001 | Nichols et al. | 164/137 |

FOREIGN PATENT DOCUMENTS

EP 0 423 477 A2 4/1991

* cited by examiner

*Primary Examiner*—M. Alexandra Elve
*Assistant Examiner*—Len Tran
(74) *Attorney, Agent, or Firm*—Venable; Robert Kinberg

(57) ABSTRACT

An apparatus for casting molded parts includes a casting mold having a lower core, an upper core and pushing elements, which, in a first end position, are in contact so as to form a hollow space into which a liquid casting mass can be introduced during a casting process. The upper core, which rests against the inside of the molded part is displaceable in an insertion direction in order to remove the molded part comprising a hardened casting mass. The upper core has a jacket surface and a bore that extends at a predetermined angle with respect to the insertion direction. An actuating element is displaceable in the insertion direction. An undercut pushing element is coupled to the actuating element via a crossbeam and has a front end that is movable between first and second end positions. Due to a displacement of the actuating element, the undercut pushing element travels in the bore of the upper core part with the front end of the undercut pushing element protruding laterally beyond the jacket surface of the upper core in the first end position during the casting process. The front end of the undercut pushing element assumes the second end position which either flush with the jacket surface of the upper core or disposed behind the jacket surface, when the upper core is removed from the casting mold.

16 Claims, 2 Drawing Sheets

APPARATUS FOR CASTING A MOLDED PART

CROSS-REFERENCE TO RELATED APPLICATIONS

Priority is claimed with respect to Application No. 100 04 714.9-24 filed in Germany on Feb. 3, 2000, the disclosure of which is incorporated herein by reference.

BACKGROUND OF THE INVENTION

The invention relates to an apparatus for casting a molded part, the apparatus including a casting mold having a lower core, an upper core and pushing elements which, in a first end position, are in contact so as to form a hollow space into which a liquid casting mass can be introduced, with the upper core, which rests against the inside of the molded part, being displaced in an insertion direction in order to remove the molded part comprising a hardened casting mass.

An apparatus of this type is particularly useful for casting aluminum molded parts, such as automobile wheel rims.

To form the casting mold, the upper core is moved from above toward the lower core in the insertion direction. The pushing elements move laterally toward the upper and lower cores, so as to form the hollow space between the pushing elements, the upper core and the lower core, into which the liquid casting mass, preferably liquid aluminum, is poured.

The molded part corresponding to the shape of the hollow space has side walls that are essentially located between the pushing elements and the upper core, and a front wall that is located between the upper and lower cores, and is open to the rear side.

After the casting mass has hardened into the molded part, the upper core is moved upward again in the insertion direction, and removed from the molded part by way of the rear opening of the part. The molded part can be detached from the lower core and removed after the pushing elements have been removed.

As the upper core is removed from the molded part, the outside wall of the upper core slides along the inside of the molded part.

To make the upper core detachable from the molded part, the inside diameter of the molded part tapers continuously toward the front wall. Accordingly, the outside diameter of the upper core tapers continuously toward the front end.

If, in contrast, the upper core were to have a local widened area of its cross section that protruded beyond a jacket surface of the upper core, the inside of the side wall of the molded part would have a corresponding recess that would surround the widened cross section. Thus, the upper core would be fixedly held against the molded part, and could not be detached from the molded part.

It is, however, often desirable to create such recesses or, in general, undercut regions on the inside of the molded part. Undercut regions of this type may be required due to the desired shape of the molded part, for example to assure specific functions of the molded part. In addition, such undercut regions can also contribute to considerable material savings. Cutting these regions into the molded parts would necessitate additional processing after the casting procedure.

These additional manufacturing steps require an undesired additional outlay for machinery and labor, which significantly increases the production costs for these molded parts.

SUMMARY OF THE INVENTION

It is an object of the invention to embody an apparatus of the type mentioned at the outset such that undercut regions can be created in the respective molded part during the casting process.

The above and other objects are accomplished according to the invention by the provision of a casting mold having a lower core, an upper core and pushing elements which are movable into a position in contact with one another to form a hollow space into which a liquid casting mass can be introduced during a casting process, with the upper core, which rests against the inside of the molded part, being displaceable in an insertion direction in order to remove the molded part constituted by a hardened casting mass, the upper core having a jacket surface and a bore that extends at a predetermined angle with respect to the insertion direction; an actuating element displaceable in the insertion direction; a crossbeam; and an undercut pushing element coupled to the actuating element via the crossbeam and having a front end that is movable between first and second end positions, wherein due to a displacement of the actuating element, the undercut pushing element travels in the bore of the upper core with the front end of the undercut pushing element protruding laterally beyond the jacket surface of the upper core in the first end position during the casting process, and with the front end of the undercut pushing element assuming the second end position that is one of (a) flush with the jacket surface of the upper core and (b) disposed behind the jacket surface, when the upper core is removed from the casting mold.

The apparatus according to the invention thus has an actuating element that can be displaced in the insertion direction, and to which an undercut pushing element is coupled, via a crossbeam, such that the undercut pushing element travels in a bore in the upper core, which extends at a predetermined angle with respect to the insertion direction, when the actuating element is actuated.

During the casting process, the undercut pushing element assumes a first end position, in which its front end protrudes laterally beyond the jacket surface of the upper core. When the upper core is removed, the front end of the undercut pushing element assumes a second end position which ends flush with the jacket surface of the upper core, or lies behind the jacket surface.

The undercut pushing element of the invention can be used to create defined undercut regions at predetermined locations on the inside of the molded part. The size and shape of the undercut regions can be predetermined simply through the selection of the front end of the undercut pushing element. It is especially advantageous to provide a plurality of undercut pushing elements for creating numerous undercut regions.

An essential advantage of the apparatus of the invention is that the undercut regions can be cut into the molded part during the casting process without impeding the removal of the upper core from the inside region of the molded part.

For this purpose, prior to the casting process, the actuating element displaces the undercut pushing element into its first end position, in which the front end of the undercut pushing element protrudes beyond the jacket surface of the upper core. Accordingly, a corresponding undercut region is created on the inside of the molded part during the casting process.

After the casting mass has hardened into the molded part, the actuating element displaces the undercut pushing element into its second end position, so the front end of the undercut pushing element no longer protrudes beyond the jacket surface of the upper core. Thus, the upper core can be removed from the molded part unimpeded.

A further significant advantage of the invention is that the undercut pushing element is coupled to the actuating element via the crossbeam. The crossbeam converts the linear movement of the actuating element into a likewise linear movement of the undercut pushing element, so the undercut pushing element does not execute a movement parallel to the insertion direction, in which the actuating element moves, but at a predetermined angle with respect to this direction. The angle is determined by the embodiment of the crossbeam, and is preferably between 90° and 180°.

It is particularly advantageous that an actuating element that moves parallel to the insertion direction can move the undercut pushing element.

The actuating element can be simply coupled to the moving mechanisms for moving the upper core, which is likewise moved in the insertion direction.

The moving mechanism for deflecting the undercut pushing element can therefore be produced with low labor and cost requirements.

In an especially advantageous embodiment, the apparatus of the invention is used to produce automobile wheel rims, preferably comprising aluminum.

In this case, the undercut regions are preferably disposed where the spokes are connected to the rim base of the automobile wheel rim.

The undercut regions considerably reduce the weight of such automobile wheel rims, for example by 400 g to 1000 g, depending on the rim embodiment. This results in significant material and cost savings.

A further advantage is that the undercut regions prevent the formation of undesired material buildup, and therefore bubbles, which greatly reduces the rejection quotas in the production of automobile wheel rims.

The creation of undercut regions lends the automobile wheel rim an essentially constant wall thickness, resulting in better casting and an improved distribution of force over the automobile wheel rim, which greatly increases the stability of the automobile wheel rim.

BRIEF DESCRIPTION OF THE DRAWINGS

The invention is described below in conjunction with the drawings.

DETAILED DESCRIPTION OF THE INVENTION

Figure 1:
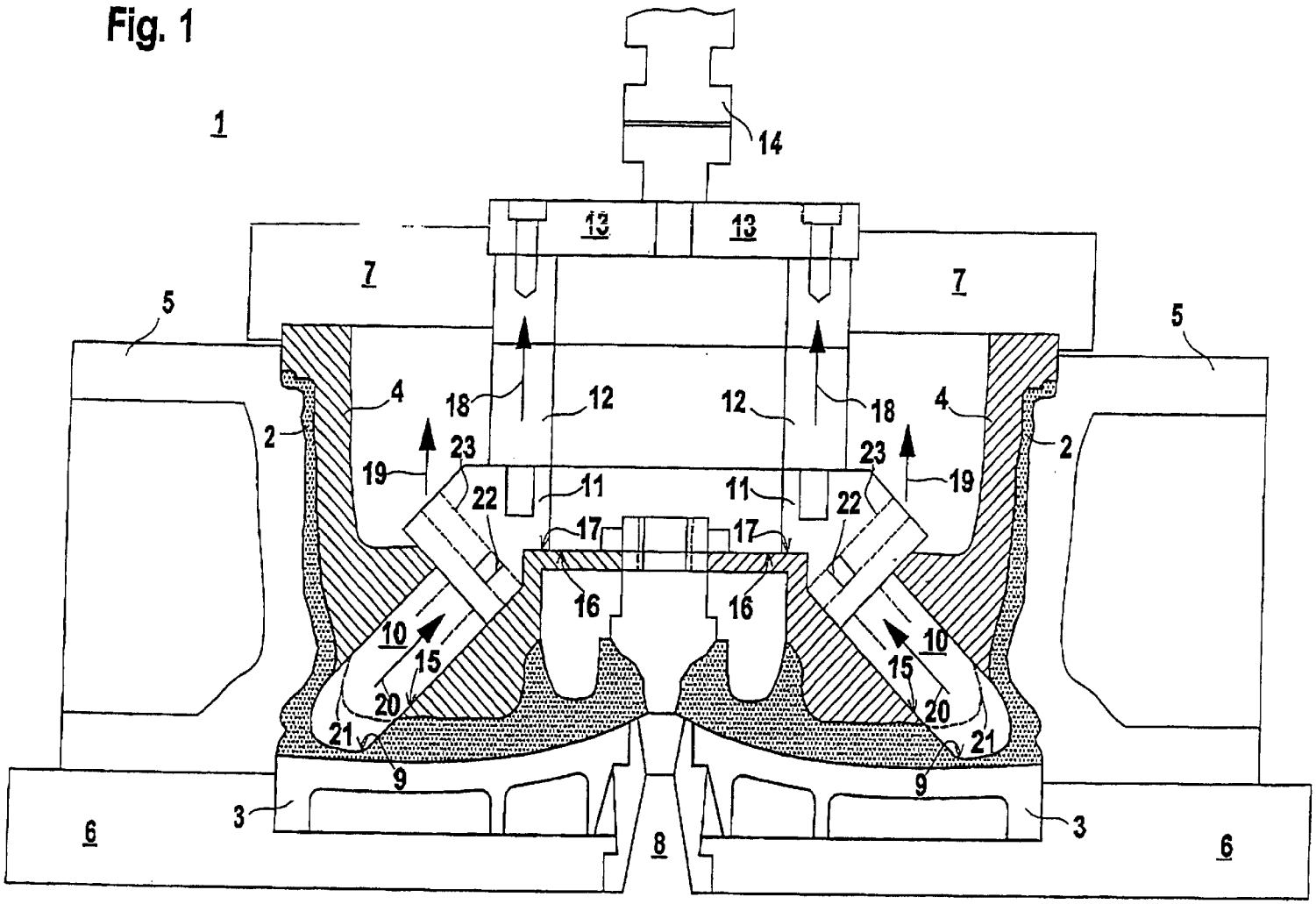
FIG. 1 is a cross section through a part of the apparatus according to the invention for casting a molded part, with undercut pushing elements that are respectively coupled to a crossbeam.

FIG. 1 illustrates an apparatus 1 for casting a molded part 2. In the present exemplary embodiment, the molded part 2 comprises an automobile wheel rim, preferably made of aluminum.

The apparatus 1 includes a lower core 3, an upper core 4 and a plurality of pushing elements 5, which together form a casting mold for producing the molded part 2. The casting mold has a hollow space that corresponds to the shape of the molded part 2, and into which a liquid casting mass, preferably liquid aluminum, is poured.

The lower core 3 is seated on a base plate 6, and forms the lower part of the casting mold. The lower core 3 is fixedly anchored to the base plate 6. The upper core 4 and the pushing elements 5, in contrast, are displaceable.

The upper core 4 is secured to a retaining plate 7. The retaining plate 7 is disposed to be displaced with the upper core 4 in an insertion direction, which, in the present embodiment, extends in the vertical direction. To form the casting mold, the upper core 4 is lowered vertically onto the lower core 3. Additionally, a plurality of pushing elements 5 disposed adjacently around the circumference of the apparatus 1 is moved horizontally toward the lower core 3 and the upper core 4.

As shown in FIG. 1, sections of the pushing elements 5 rest tightly against the upper core 4 and the lower core 3, so the casting mold formed from these components has a hollow space, into which the aluminum is poured. This hollow space is formed by limiting surfaces of the upper core 4, the lower core 3 and the pushing elements 5.

The liquid aluminum is introduced into the hollow space of the casting mold via an insertion opening 8 in the lower core 3. This insertion opening 8 lies in the vertically-extending axis of symmetry of the apparatus 1 and the molded part 2. The molded part 2, comprising the automobile wheel rim, is embodied to be essentially rotationally symmetrical with respect to the rotational axis. Accordingly, the apparatus 1 is also embodied to be essentially rotationally symmetrical.

As can be seen in FIG. 1, the essentially cylindrical side wall of the molded part 2 is disposed between the pushing elements 5 and the lateral jacket surface of the upper core 4. The front wall of the molded part 2 is disposed between the upper core 4 and the lower core 3. In the molded part 2 comprising the automobile wheel rim, a plurality of spokes terminates into a rim base in the edge region of the front wall.

After the casting mass has hardened in the hollow space to form the molded part 2, the molded part is removed from the apparatus 1. To this end, first the upper core 4, which projects past the open rear side of the molded part 2 and into its interior, is moved vertically upward until the insides of the molded part 2 are exposed. The pushing elements 5 are moved laterally away from the outside walls, so the molded part 2 can be removed.

To allow the upper core 4 to be removed from the interior of the molded part 2, the inside diameter of the molded part 2 tapers inwardly basically continuously toward the front wall.

In accordance with the invention, a plurality of undercut regions 9 is provided where the rim base is connected to the rim spokes, the base bordering the side wall of the molded part 2. The undercut regions 9 extend to the inside of the side wall of the molded part 2 that border the rim base, which results in local widened regions of the cross section of the interior of the molded part 2. A plurality of undercut pushing elements 10 disposed at predetermined intervals at the circumference of the upper core 4 creates these undercut regions 9 during the casting process.

Each undercut pushing element 10 is coupled via a crossbeam 11 to an actuating element. The actuating element essentially includes a column 12, which is secured to the crossbeam 11, with the column 12 preferably being screwed to the crossbeam 11. The longitudinal axis of the cylindrical column 12 extends vertically. The column 12 is secured by its front face to the crossbeam 11. The rear face of the column 12 is secured to a tension plate 13. The tension plate 13 is seated horizontally on the retaining plate 7, to which the upper core 4 is secured. A cylinder 14 terminates at the top of the tension plate 13. The cylinder 14 serves to move the tension plate 13 vertically, whereby the columns 12 secured to the tension plate 13 execute a corresponding vertical movement.

The undercut pushing element 10 is guided in a bore 15 of the upper core 4. The longitudinal axis of the undercut pushing element 10, and therefore the longitudinal axis of the bore 15, extend at an angle $\alpha$ with respect to the vertical insertion direction, the angle being between 90° and 180°. In the present exemplary embodiment, the angle $\alpha$ is about 135°.

The undercut pushing element 10 is movably coupled to the crossbeam 11, which is in turn fixedly connected to the column 12.

This coupling permits the conversion of a vertical movement of the column 12 by way of the cross beam 11 such that the undercut pushing element 10 is displaced in the bore 15.

In accordance with the invention, the deflection of the column 12 displaces the undercut pushing element 10 between first and second end positions.

Before the casting process begins, the undercut pushing element 10 is displaced into its first end position. In this first end position, the front end of the undercut pushing element 10 protrudes beyond the jacket surface of the upper core 4, and fills the undercut region 9 of the hollow space into which the casting mass is poured. FIG. 1 illustrates this first end position for the two undercut pushing elements 10. When an undercut pushing element 10 is located in the first end position, a rear side of the cross beam 11 coupled to this pushing element rests on a right angle shoulder 16 of the upper core 4. The crossbeam 11 has a corresponding right angle recess 17, which is adapted to the shoulder 16 of the upper core 4, so the crossbeam 11 and recess 17 are in a form-fitting connection on the shoulder 16 of the upper core 4.

When the undercut pushing elements 10 are in these end positions, the casting mass is poured into the hollow space. The undercut pushing element 10 rests with its rear part tightly against the wall of the bore 15. This ensures that the casting mass cannot seep into the space between the undercut pushing element 10 and the bordering part of the upper core 4 during the casting process. Because the free end of each undercut pushing element 10, which protrudes beyond the upper core 4, protrudes into the respective undercut region 9, this undercut region 9 is not filled with the casting mass during the casting process.

Following the casting process, the casting mass hardens into the molded part 2, whereupon the upper core 4 is lifted vertically via the open rear side of the molded part 2, and removed.

When the undercut pushing elements 10 assume the first end position, it is not possible to detach the upper core 4, because the front ends of the undercut pushing elements 10 are still protruding into the respective undercut regions 9, and are therefore located in the corresponding recesses in the inside wall of the molded part 2, which holds the upper core 4 securely to the molded part 2.

Therefore, the undercut pushing elements 10 are displaced into their second end position before the upper core 4 is removed. To this end, the tension plate 13 is displaced vertically upward with the columns 12. The first arrows 18 in FIG. 1 indicate the directions of movement of the columns 12. The crossbeam 11 coupled to the columns 12 are thereby moved vertically upward. The second arrows 19 indicate the directions of movement of the crossbeams 11. The upward vertical movement of the crossbeams 11 displaces the undercut pushing elements 10 longitudinally in the bores 15 into the upper core 4 in the manner described below. The third arrows 20 in FIG. 1 indicate the directions of movement of the undercut pushing elements 10.

Each undercut pushing element 10 is displaced into the upper core 4 until it assumes its second end position. In this second end position, the front end of the undercut pushing element 10 is disposed behind the jacket surface of the upper core 4. In FIG. 1, a dashed line indicates the outside edge 21 of the front end of an undercut pushing element 10 located in the second end position.

An undercut pushing element 10 located in the second end position no longer protrudes beyond the outside of the upper core 4, so the respective undercut region 9 remains exposed. Thus, the upper core 4 can be successfully removed from the molded part 2.

For its connection to the crossbeam 11, the undercut pushing element 10 is fixed to a guide element 22, which extends into a guide groove 23 of the crossbeam 11. The longitudinal axis of the guide groove 23 in the crossbeam 11 extends at an acute angle $\beta$ with respect to the vertical insertion direction in which the column 12 is moved. The angle $\beta$ is preferably about 45°. The longitudinal axis of the guide groove 23 extends perpendicular to the longitudinal axis of the undercut pushing element 10. The vertical movement of the column 12 together with crossbeam 11 causes the guide element 22 to have a relative movement along the guide groove 23. An upward vertical movement of the crossbeam 11 including its groove 23 is translated to a downward diagonal relative movement of the guide element 22 in guide groove 23, so that the undercut pushing element 10 is withdrawn from the recess of undercut region 9 as it is displaced longitudinally in bore 15. Similarly, a downward vertical movement of column 12 and crossbeam 11 results in a upward diagonal relative movement of guide element 22 in guide groove 23 as undercut pushing element 10 in displaced longitudinally in bore 15 into the recess of undercut region 9.

The angular ratios illustrated in FIG. 1, particularly the orientation of the guide groove 23 relative to the direction of movement of the column 12, and relative to the direction of movement of the undercut pushing element 10, are selected such that the movement of the crossbeam 11 exerts essentially only vertical forces, but not transverse forces, on the undercut pushing element 10, so the undercut pushing element 10 is guided in the bore 15 with a small frictional force.

Figure 2:
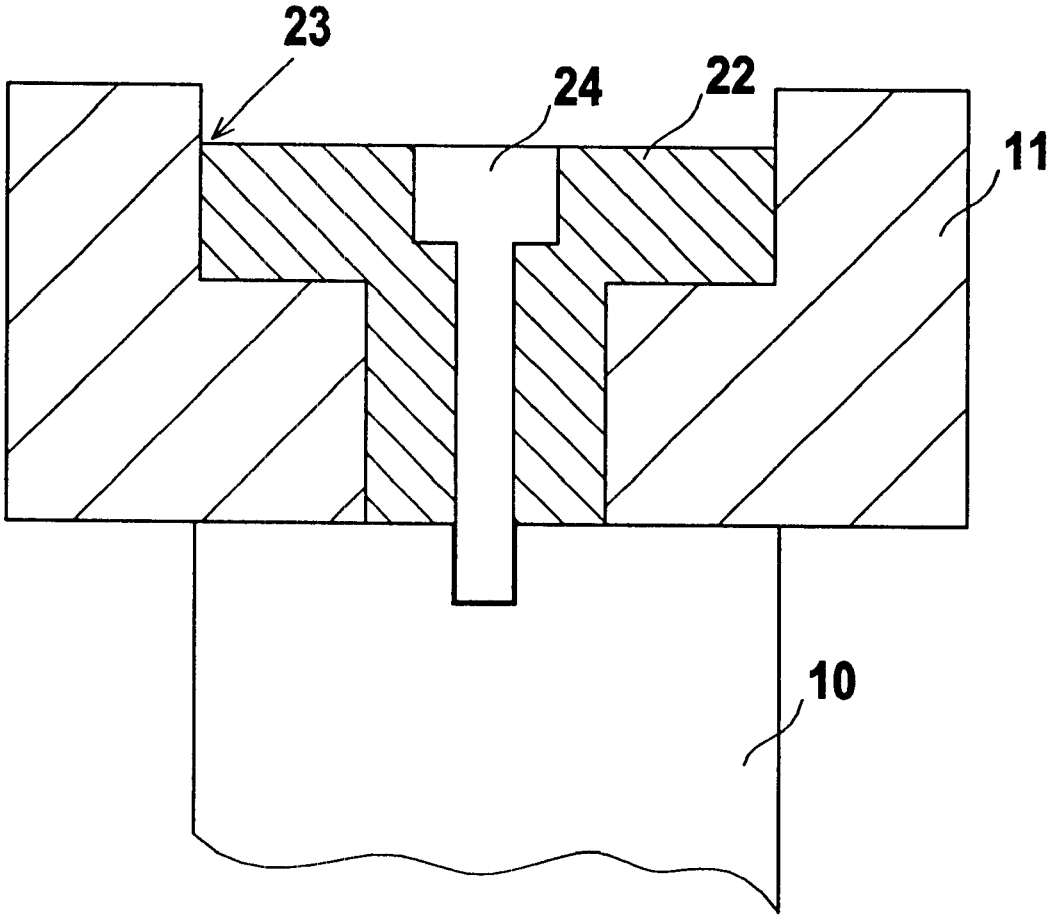
FIG. 2 is a cross section through a portion of the crossbeam and a portion of the undercut pushing element in FIG. 1 along a plane normal to the sheet.

FIG. 2 illustrates the design of the guide element 22 and the guide groove 23. The guide element 22 has a T-shaped cross section, and is screwed onto a surface segment of the undercut pushing element 10. The cross section of the guide groove 23 in the crossbeam 11 is likewise T-shaped, and is adapted to the cross section of the guide element 22.

The guide element 22 is inserted into the T-shaped guide groove 23 to effect the coupling of the undercut pushing element 10 to the crossbeam 11.

The undercut pushing element 10 is guided from below to the crossbeam 11, so the surface segment of the undercut pushing element 10 rests against the underside of the guide groove 23. A screw 24 is then inserted into a bore that axially penetrates the guide element 22. The screw is screwed to the undercut pushing element 10. This procedure safeguards the undercut pushing element 10 against detaching from the crossbeam 11. The screw 24 is only tightened to the extent that the guide element 22 can still be moved in the guide groove 23.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for casting molded parts, comprising:

a casting mold having a lower core, an upper core and pushing elements, which, in a first end position, are in contact so as to form a hollow space into which a liquid casting mass can be introduced during a casting process, with the upper core, which rests against the inside of the molded part, being displaceable in an insertion direction in order to remove the molded part comprising a hardened casting mass, the upper core having a jacket surface and a bore that extends at a predetermined angle with respect to the insertion direction;

an actuating element displaceable in the insertion direction;

a crossbeam having a guide groove which extends along a straight line;

an undercut pushing element coupled to the actuating element, via the crossbeam and having a front end that is movable between first and second end positions, and a guide element that protrudes from the undercut pushing element and extends into the guide groove of the crossbeam;

wherein the undercut pushing element has a planar surface segment, and the guide element has a T-shaped cross section and an underside that is screwed to the planar surface segment of the undercut pushing element;

wherein due to a displacement of the actuating element, the undercut pushing element travels in the bore of the upper core with the front end of the undercut pushing element protruding laterally beyond the jacket surface of the upper core in the first end position during the casting process, and with the front end of the undercut pushing element assuming the second end position that is one of (a) flush with the jacket surface of the upper core and (b) disposed behind the jacket surface, when the upper core is removed from the casting mold.

2. The apparatus according to claim 1, wherein the undercut pushing element has a longitudinal axis that extends at an angle $\alpha$ between 90° and 180° with respect to the insertion direction, and the front end terminates at a lower edge of the upper core.

3. The apparatus according to claim 2, wherein the angle $\alpha$ is about 135°.

4. The apparatus according to claim 1, wherein the guide groove has a T-shaped cross section adapted to the cross section of the guide element, and when the guide element is seated in the guide groove, the planar surface segment of the undercut pushing element rests against an underside of the crossbeam.

5. The apparatus according to claim 1, wherein the guide groove has a longitudinal axis that extends at an acute angle $\beta$ with respect to the insertion direction.

6. The apparatus according to claim 5, wherein the angle $\beta$ is about 45°.

7. The apparatus according to claim 6, wherein the longitudinal axis of the guide groove in the crossbeam extends perpendicular to the longitudinal axis of the undercut pushing element.

8. The apparatus according to claim 1, wherein the actuating element comprises a column that is displaceable in the insertion direction and has a front face that is secured to the crossbeam.

9. The apparatus according to claim 8, wherein, when the column is displaced, the guide element of the undercut pushing element travels in the guide groove of the crossbeam, with the undercut pushing element being displaced in the longitudinal direction of the undercut pushing element.

10. The apparatus according to claim 8, and further including a tension plate having a planar top and a cylinder extending perpendicularly from the planar top of the tension plate for displacing the tension plate in the insertion direction, wherein the column has a rear face that is secured to the tension plate for being displaced by the cylinder via the tension plate in the insertion direction.

11. The apparatus according to claim 10, wherein the molded part has an essentially rotationally symmetrical molded body with a front wall disposed between the upper core and the lower core, and an essentially cylindrical side wall disposed between the pushing elements and the upper core, the molded part having an axis of symmetry extending parallel to the insertion direction.

12. The apparatus according to claim 11, wherein the upper core is removable via an open rear side of the molded part.

13. The apparatus according to claim 12, further including a retaining part to which the upper core is secured and on which the tension plate is seated.

14. The apparatus according to claim 10, wherein the undercut pushing element comprises a plurality of undercut pushing elements disposed at a circumference of the molded part for creating undercut regions in an inside wall of the molded part.

15. A method of making an automobile wheel rim, comprising utilizing the apparatus of claim 11, wherein the molded part comprises the automobile wheel rim, and the automobile wheel rim has undercut regions where spokes are connectable to a rim base of the automobile wheel rim.

16. The method according to claim 15, further comprising using aluminum for the molded part forming the automobile wheel rim.

* * * * *